US006189719B1

(12) United States Patent
Kanoya et al.

(10) Patent No.: US 6,189,719 B1
(45) **Date of Patent: *Feb. 20, 2001**

(54) PLASTIC COVER FOR A CONTAINER

(75) Inventors: Katsuhiko Kanoya; Hideo Okada, both of Tokyo (JP)

(73) Assignee: Mitani Valve Co. (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/235,661

(22) Filed: Jan. 22, 1999

(30) Foreign Application Priority Data

Jul. 1, 1998 (JP) ..... 10-222242

(51) Int. Cl.[7] ..... B65D 41/18; B65D 47/12

(52) U.S. Cl. ..... 220/281; 215/317; 220/724; 220/784; 220/915

(58) Field of Search ..... 220/281, 253, 220/285, 780, 784, 724, 729, 915, 790, 791, 793; 215/26, 28, 29, 295, 317, 321, 224

(56) References Cited

U.S. PATENT DOCUMENTS 2,901,140 * 8/1959 Robinson ..... 215/321
3,411,660 * 11/1968 Lafarge ..... 220/784 X
3,854,622 * 12/1974 McKirnan ..... 220/784
3,964,634 * 6/1976 Jasinski et al. ..... 220/281
4,257,526 * 3/1981 Weits et al. ..... 215/321
5,722,568 * 3/1998 Smith ..... 220/281 X

* cited by examiner

*Primary Examiner*—Allan N. Shoap
*Assistant Examiner*—Niki M. Eloshway
(74) *Attorney, Agent, or Firm*—Bierman, Muserlian and Lucas

(57) ABSTRACT

The plastic cover is easily removed from a metal container to allow the plastic cover and the metal container to be separately recycled. The lip that holds the plastic cover to the metal container has two or more circumferential ends which have a lower degree of engagement than the remaining portion of the lip. A press point on the cover which transforms the circular cover into an elliptical shape is positioned on the outside of the cover opposite the circumferential ends and a shoulder is mounted inside the cover opposite the press point. The shoulder bears against the container to assist in removal of the cover. Where the cover has both an inner cylinder and an outer cylinder, a rib is employed to connect the inner cylinder of the cover to the outer cylinder of the cover and to transfer pressure from the press point to the inner cylinder.

7 Claims, 8 Drawing Sheets

PLASTIC COVER FOR A CONTAINER

BACKGROUND OF THE INVENTION

1. Field of the Invention

This invention relates to a plastic cover for a metal container and, more particularly, to a plastic cover which is removable from the metal container to allow the plastic cover and the metal container to be separately recycled. The cover is especially suited for aerosol cans.

2. Prior Art

A typical aerosol can has a plastic cover which is attached at the upper face of a metal container. The container holds its contents under pressure and the cover has a nozzle which allows the user to release the contents from the container. The cover is usually firmly attached to the container by the interaction between a lip on the cover and a top lip or curl of the container. Because of the tight lock between the lip of the cover and the curl of the container, the two are recycled together, rather than separately. Because the container and cover are made of different materials, there is a need to separate the two for efficient recycling.

One suggestion for making the cover easily removable from the container is suggested in Japanese Patent Application No. 9-52584. The teachings of the '584 application are illustrated in FIGS. 6A–6C. As shown in FIGS. 6A–6C, cover 7 is attached to container 8. Cover 7 has nozzle 71 and inner cylinder 72 with an opening or discontinuous portion 72'. Attached to inner cylinder 72 is lip 73, which is shown as two sections. Each section has two circumferential ends 74 and a side portion 74'. Lip 73 is uniform in dimensions throughout, i.e. from circumferential end to circumferential end. Outer cylinder 75 has press point 76 which is used to deform cover 7 into an elliptical shape as shown in FIG. 6C. When cover 7 is deformed into this elliptical shape, cover 7 can be removed from container 8. Conventionally, cover 7 is molded from a plastic material into one piece and container 8 is made of metal.

Metal container 8 has a sloping wall section 81, curl 82 and stem 83. Stem 83 along with the other structure, not shown, allows for the contents of container 8 to be jetted out of container 8. Curl 82 interacts with lip 73 to hold cover 7 onto container 8 in a conventional way. Stem 83 fits through nozzle 71 as shown in FIG. 6A.

To assemble cover 7 on container 8, cover 7 is pushed down onto container 8 and lip 73 forces inner cylinder 72 to flex outward while lip 73 rides over curl 82. Lip 73 then locks into the concave portion under curl 82 and holds cover 7 onto container 8.

To remove cover 7 from container 8, the user pushes on press point 76 to force cover 7 into an elliptical shape as shown in FIG. 6C. A gap forms between curl 82 and side portion 74' of lip 74 and cover 7 can be removed from container 8.

Although the arrangement in FIGS. 6A–6C allows cover 7 to be removed from container 8, there is a need to improve this arrangement and make it easier to separate the two components, cover 7 and container 8.

SUMMARY OF THE INVENTION

A plastic cover which is easily removed from a metal container has now been discovered. The cover of the present invention is easily removed from the container because it employs a curl engaging member which has at least two circumferential ends, wherein the circumferential ends have a degree of engagement with the curl that is less than the degree of engagement between the curl and a side portion of the curl engaging member.

The curl engaging member can be a lip that holds the cover to the container by residing in the concave portion below the curl of the container, or a concave portion in which the curl of the container resides when the cover and the container are joined together. Preferably, the curl engaging member is a lip.

The cover of the present invention is either a cover having two concentric cylinders, an inner cylinder and an outer cylinder, or is a cover with a single outer cylinder. In either case, the curl engaging member is affixed inside the cover and engages the curl to hold the cover onto the container during normal operation.

In order to remove the cover from the container in accordance with the present invention, the cover has a press point that is pushed by the user to cause the cover to form an elliptical shape. The press point is positioned on the outside of the cover.

The curl engaging member is not a circle but is discontinuous, such that it has at least two circumferential ends. Preferably, the curl engaging member has two circumferential ends. These circumferential ends define one or more openings in the curl engaging member. At least one of the openings is positioned opposite the press point.

When the press point is pressed and the cover forms an elliptical shape, the side portion of the curl engaging member becomes disengaged from the curl and the circumferential ends are designed to slide easily over the curl because they have a low degree of engagement with the curl. The side portion of the curl engaging member is generally that portion of the curl engaging member that extends from one circumferential end to the other circumferential end. In the case where there are only two circumferential ends and the curl engaging member takes on the shape of the letter "C", then the side portions of the curl engaging member correspond to the top and bottom of the "C". The back portion of the curl engaging member is that portion which corresponds to the back of the "C" and directly opposite the opening of the "C". In the case where there are four circumferential ends, the back of the curl engaging member is absent. As mentioned above, the front of the "C" faces the press point in the cover.

The side portion of the curl engaging member has a higher degree of engagement with the curl of the container than the circumferential ends and accounts for the majority of the curl engaging member.

There are a number of ways in which to make the circumferential ends of the curl engaging member have a degree of engagement with the curl that is less than the side portion degree of engagement with the curl. The ways to make the degree of engagement less include: (1) the circumferential ends of the curl engaging member have a radius of curvature that is greater than the radius of curvature of their side portion; or (2) the elasticity (stiffness) of the circumferential ends is lower than the side portion of the curl engaging member; or (3) the frictional coefficient between the circumferential ends and the curl is less than the coefficient of friction between the curl and the side portion of the curl engaging member.

Preferably, the radius of curvature of the circumferential ends of the curl engaging member is greater than the radius of curvature of the side portion. When the curl engaging member is a lip, the top of the circumferential end has a radius of curvature which is greater than the radius of curvature of the top of the side portion of the lip. When the curl engaging member is a concave portion in which the curl resides, the bottom of the circumferential ends have a radius of curvature that is more than the radius of curvature of the bottom of the side portion of the concave portion.

Preferably, a shoulder is formed on the inside of the cover at a point which is opposite the opening formed by the circumferential ends. Preferably, the shoulder is positioned directly opposite the press point. The shoulder contacts the sloping wall section of the container when the user pushes the press point. As the user presses the press point, the shoulder contacts the upwardly sloping wall of the metal container and causes the cover to rise upwardly in response to the pressing of the user. This guides the cover up and off of the container.

Usually there is a space between the end of the cylindrical portion that the shoulder is formed on and the container. This means that there is a short lag time between when the pressure is applied to the press point and the time that pressure is exerted by the shoulder on the sloping side wall of the container.

In the case where the cover is of the type having two concentric cylinders, an inner and an outer, the curl engaging member is formed on the inside of the inner cylinder and the inner cylinder has an opening which corresponds to the opening defined by the circumferential ends of the curl engaging member. In such an arrangement, it is preferred that a rib be employed which connects the outer cylinder with the inner cylinder in order to transfer the pressure from the press point directly to the inner cylinder. Preferably, the rib is connected to the inner cylinder at the point where the inner cylinder ends and the opening begins. This is also preferably the location of the circumferential ends.

BRIEF DESCRIPTION OF THE DRAWINGS

These and other aspects of the present invention may be more fully understood by reference to one or more of the following drawings wherein.

DETAILED DESCRIPTION OF THE INVENTION

Figure 1A:
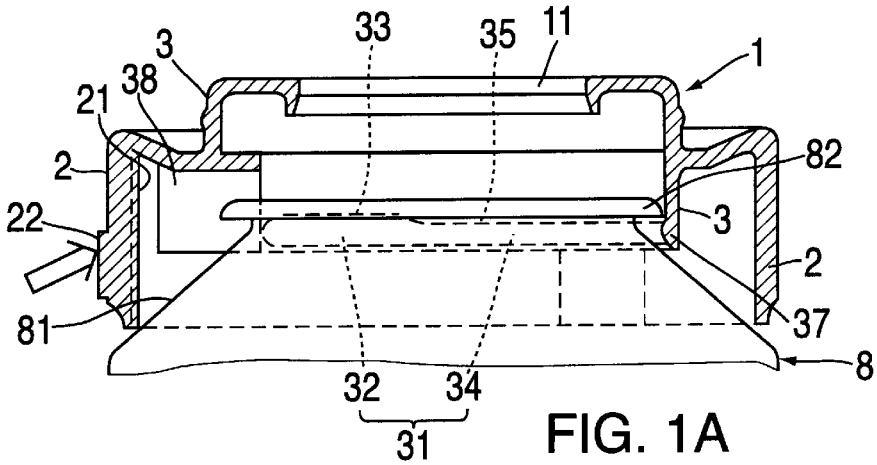
FIG. 1A illustrates a sectional view of the cover of the present invention with both inner and outer cylinders.

As shown in FIG. 1A, plastic cover 1 has outer cylinder 2 and inner cylinder 3. Cover 1 can comprise a spout 4 (see FIG. 4A). FIG. 5 illustrates plastic cover 5 made in accordance with the present invention but employing single cylinder wall 6. Both covers 1 and 5 are mounted on metal container 8.

Returning to FIG. 1A, opening 11 in cover 1 is used for a nozzle, stem and push button (not shown). Inside outer cylinder 2 is shoulder 21 and outside outer cylinder 2 is press point 22. Inner cylinder 3 has lip 31 (curl engaging member) which has circumferential ends 32 and side portion 34. Top portion 33 of circumferential ends 32 and top portion 35 of side portion 34 are the top edge of lip 31 at these two points and are used to define the radius of curvature in FIGS. 1C and 1D. Opening 36 illustrates the absence of lip 31 and the absence of inner cylinder 3. Back portion 37 of lip 31 is opposite to opening 36. Rib 38 connects inner cylinder 3 and circumferential ends 32 to outer cylinder 2. Imaginary line 39 is a boundary portion between circumferential ends 32 and side portion 34. As shown in FIGS. 1C and 1D, radius of curvature 33R is for top portion 33 of circumferential ends 32 while radius of curvature 35R is for top portion 35 of side portion 34. Radius of curvature 33R is greater than radius of curvature 35R. Central angle 36A defines opening 36.

The degree of engagement of circumferential ends 33 is less than the degree of engagement of side portion 34 because radius of curvature 33R is greater than radius of curvature 35R.

Figure 4A:
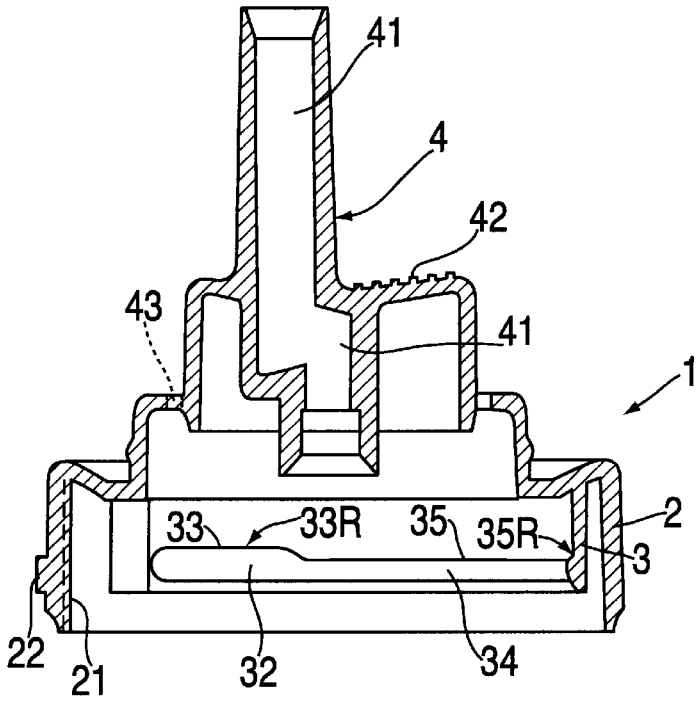
FIGS. 4A and 4B illustrate another form of a cover made in accordance with the present invention and employing an inner and an outer cylinder.

As shown in FIG. 4A, passage 41 is used for removing the contents of container 8. Push portion 42 is connected to cover 1 by connection portion 43.

Figure 5A:
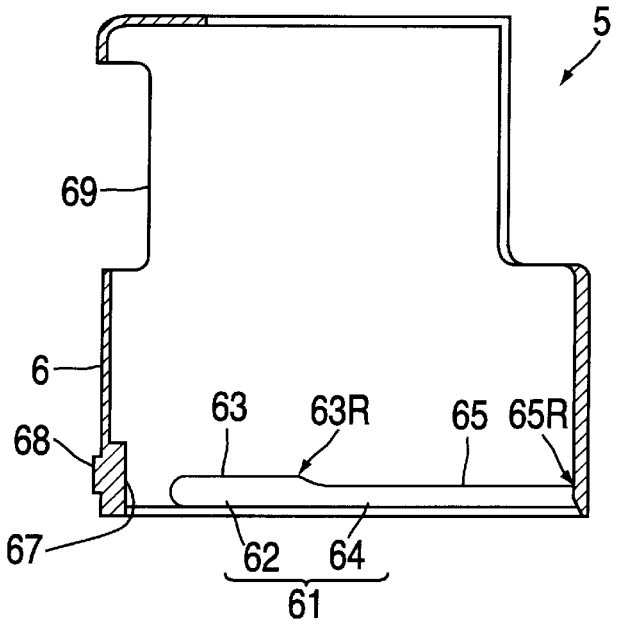
FIGS. 5A, 5B and 5C illustrate a cover of the present invention having a single cylinder.
Figure 5B:
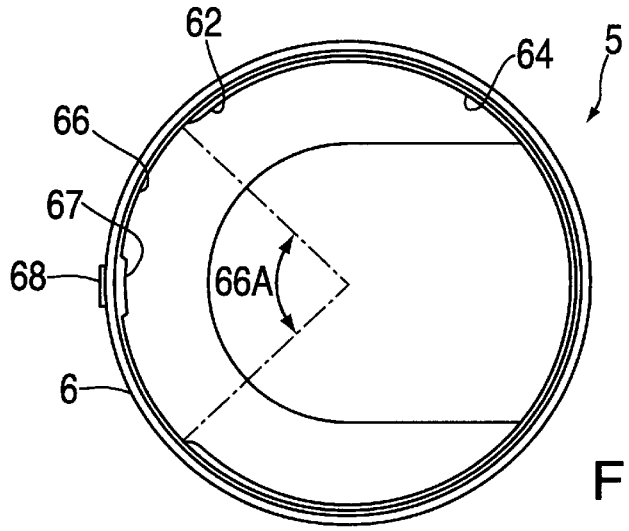

As shown in FIG. 5A, plastic cover 5 comprises a single cylinder wall 6 with opening 51 for operation. Cylinder wall 6 has lip 61 which comprises circumferential ends 62 and side portion 64. Top portion 63 of the circumferential ends 62 and top portion 65 of the side portion 64 make up the top of lip 61. Opening 66 has no lip 61 therein. Shoulder 67 is opposite press point 68 which is pressed when the plastic cover is removed from the metal container. Opening 69 is used for jetting contents from container 8. Radius of curvature 63R of top portion 63 and radius of curvature 65R of top portion 65 are illustrated. Radius of curvature 63R is greater than radius of curvature 65R. Central angle 66A measures opening 66.

The degree of engagement of circumferential ends 63 is less than the degree of engagement of side portion 64 because radius of curvature 63R is greater than radius of curvature 65R.

Plastic cover 1 and 5 are made of plastics such as polypropylene, polyethylene and so on. Metal container 8 is conventionally made of aluminum or tin and so on.

The cross section of outer cylinder 2 and single cylinder 6 is a circle in shape. The cross section of inner cylinder 3 and lip 31 and 61 is a "C" in shape because of the opening 36 and 66. Inner cylinder 3 may be formed without opening 36, however, it is preferred to have opening 36.

Opening 36 and 66 corresponds to the position of shoulder 21 and 67 and to the position of press point 22 and 68 of outer cylinder 2 and the single cylinder wall 6, respectively. Central angle 36A and 66A of opening 36 and 66 are about 50° to about 100°. Radius of curvature 33R and 63R of top portion 33 and 63 of circumferential ends 32 and 62 are, for example, 1 mm. Radius of curvature 35R and 65R of top portion 35 and 65 of side portion 34 and 64 are, for example, 0.5 mm.

Figure 4B:
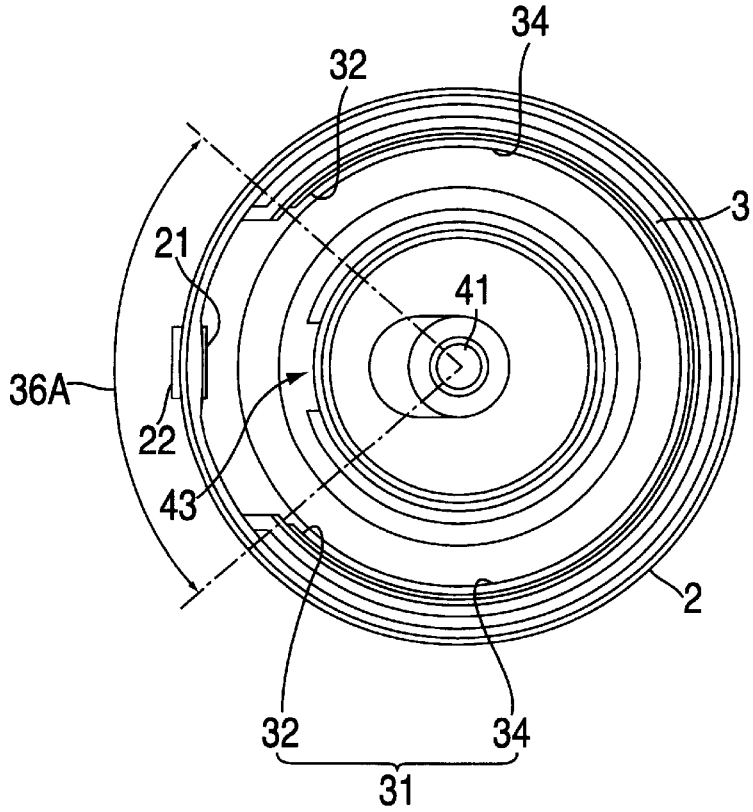

As illustrated in FIGS. 1 and 4, plastic cover 1 which is comprised of the double cylinders 2 and 3 and metal container 8 are combined by engaging lip 31 of inner cylinder 3 with curl 81 of metal container 8.

Shoulder 21 is formed on the inner face of outer cylinder 2 and corresponds to opening 36 of lip 31 while shoulder 67 is formed on the inner face of single cylinder wall 6. The lower end of shoulders 21 and 67 nearly contact sloping side wall 81 of metal container 8 when plastic cover 1 and 5 engage with metal container 8.

When a user pushes a push button (not shown) which is employed in opening 11 in FIG. 1 or push portion 42 in FIG. 4, the contents of container 8 are jetted out from container 8. Here, in the case of FIG. 4, spout 4 tilts clockwise on the connection portion 43 when a user pushes portion 42.

Figure 1B:
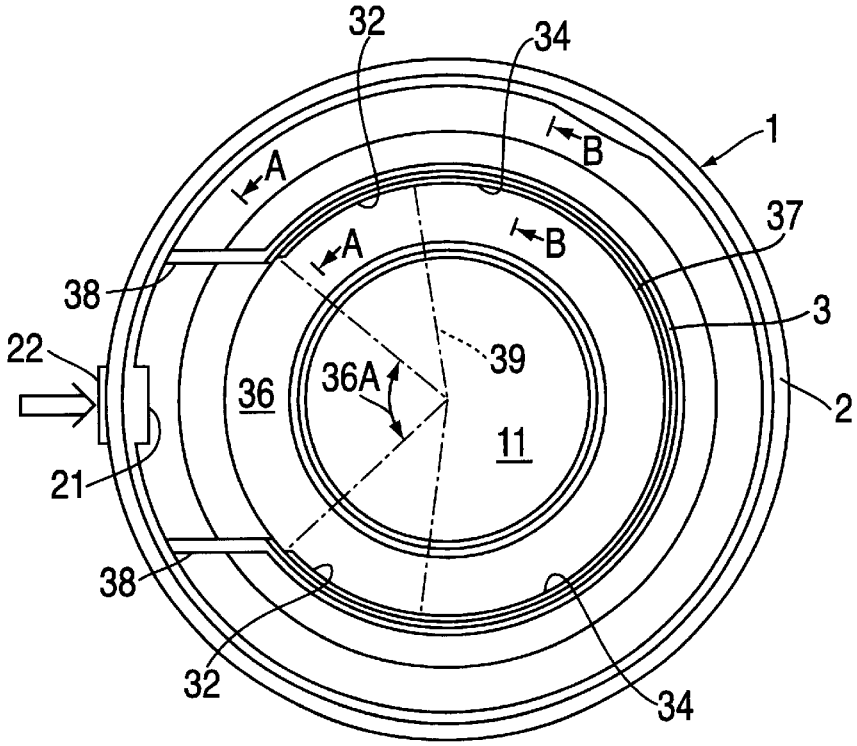
FIG. 1B illustrates a bottom view of the cover of FIG. 1A.
Figure 1C:
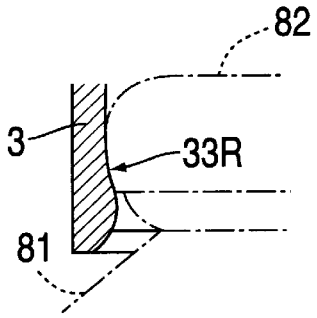
FIG. 1C illustrates the radius of curvature of the circumferential end of the lip.
Figure 1D:
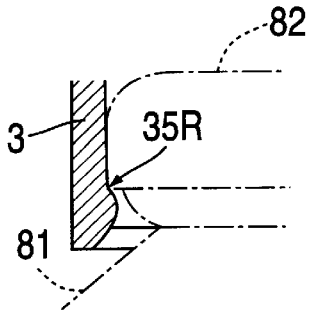
FIG. 1D illustrates the radius of curvature of the middle portion of the lip.

After the contents are used up, plastic cover 1 is easily removed from metal container 8 by pressing press point 22 in the direction of the arrows shown in FIGS. 1A and 1B.

Plastic cover 1 is easily removed from container 8 because: (1) radius of curvature 33R of top portion 33 of circumferential ends 32 is greater than radius of curvature 35R of top portion 35 of side portion 34; (2) shoulder 21 contacts sloping side wall 81 of metal container 8 when press point 22 is pressed; and (3) circumferential ends 32 of inner cylinder 3 are connected to press point 22 of outer cylinder 2 by rib 38.

When press point 22 of outer cylinder 2 is pressed, the following happens: the press force acts on circumferential ends 32 of lip 31 of inner cylinder 3 directly; outer cylinder 2, inner cylinder 3 and lip 31 are transformed into elliptical shape, side portion 34 of lip 31 is extended outward, compared to the state before press operation; at least shoulder 21 on the reverse side of press point 22 is moved inward and receives an upward force from sloping side wall 81.

Circumferential ends 32 of lip 31 are easy to lift up because they receive the force from sloping side wall 81 and because radius of curvature 33R of top portion 33 is configured to be greater than radius of curvature 35R.

As a result, the whole lip 31 slides over curl 82 in cooperation with the above mentioned elliptical transformation, and plastic cover 1 is removed from metal container 8.

Even in the case that the degree of the elliptical transformation is low, lip 31 slides over curl 82 because the degree of engagement between the circumferential ends of the lip is less than the degree of engagement of the side portion of the lip.

The upward force that moves cover 1 off of container 8 is made up of: the force which is received by the press operation directly; and the force which is received from sloping side wall 81 through shoulders 21 and 67.

Figure 2A:
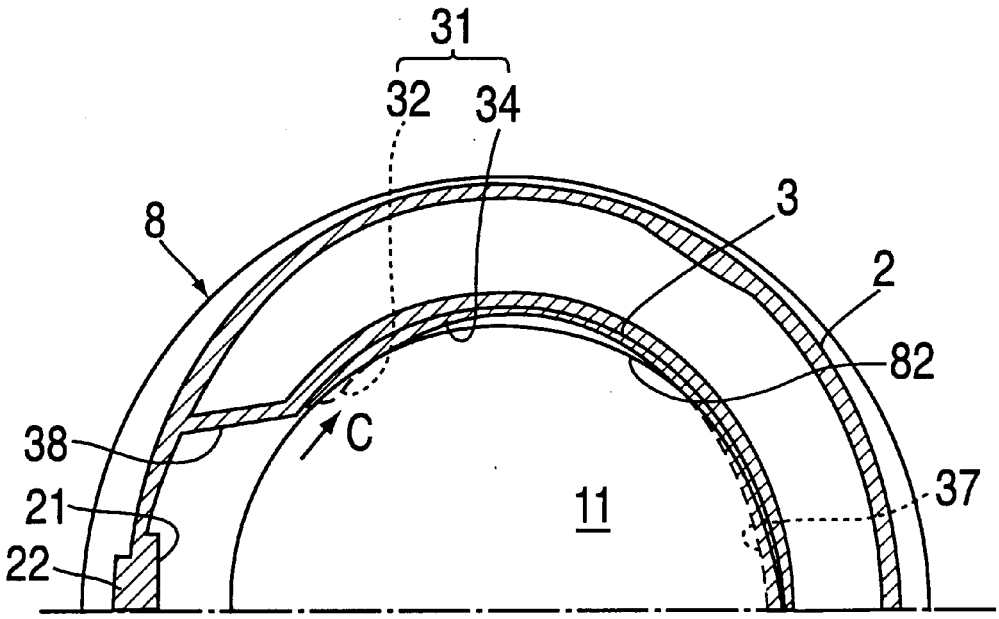
FIGS. 2A and 2B illustrate the start of disengagement between the cover and the container.
Figure 2B:
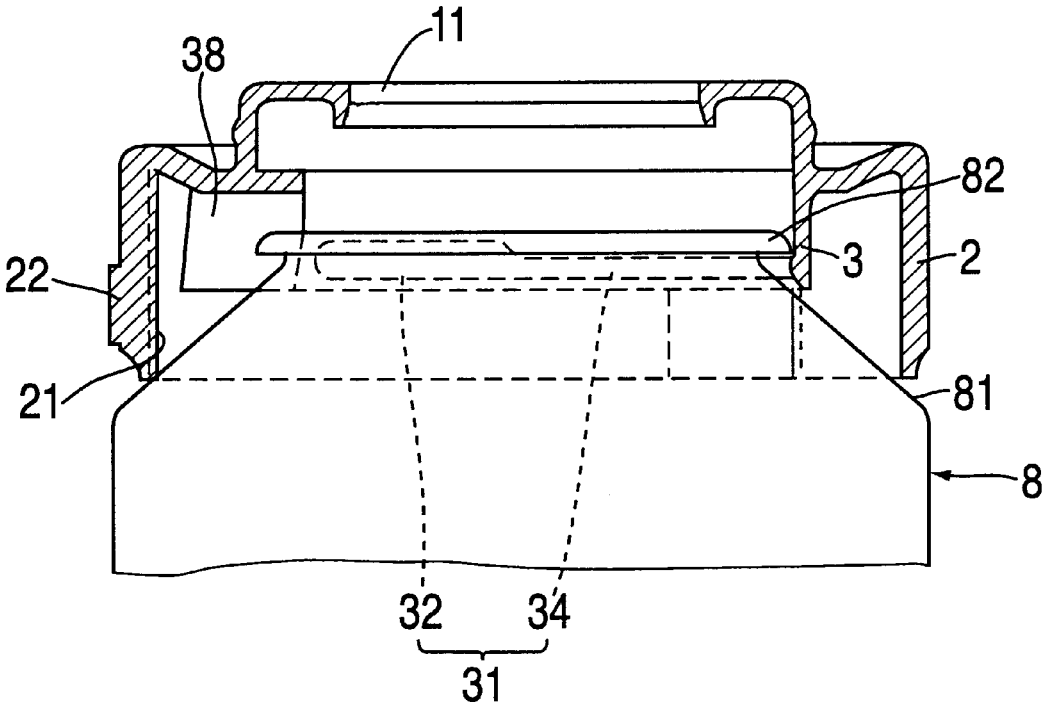

FIG. 2 shows the early stage of press operation for removing cover 1 from container 8. In this operation, circumferential ends 32 of lip 31 moves in the direction of arrow C, however, they are still engaged with curl 82 of metal container 8; side portion 34 of lip 31 extends outward from curl 82; and back portion 37 of lip 31 which is opposite to opening 36 is still engaged with curl 82.

Figure 3A:
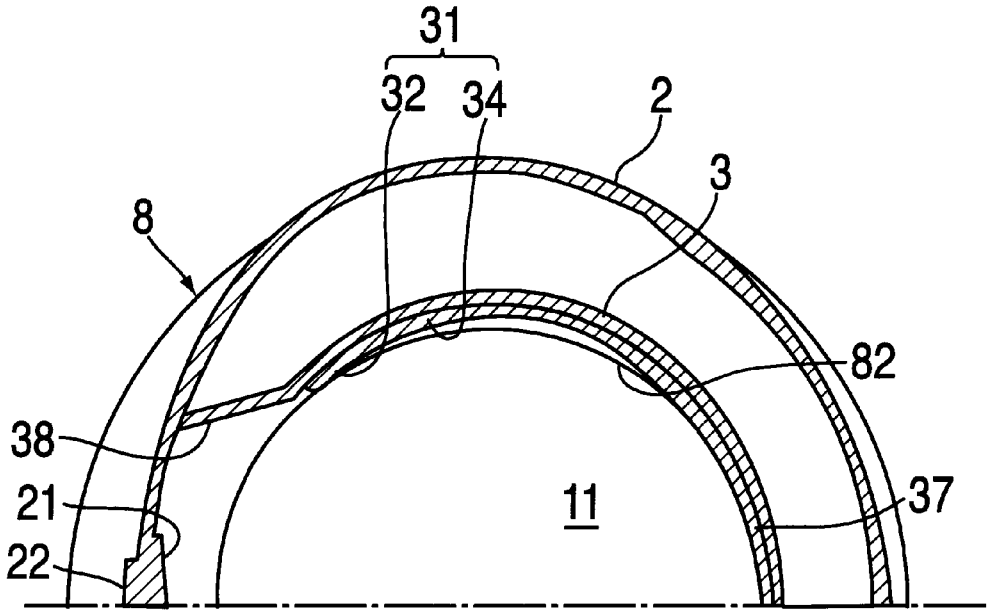
FIGS. 3A and 3B illustrate a later stage of the disengagement between the cover and the container than that which is shown in FIGS. 2A and 2B.
Figure 3B:
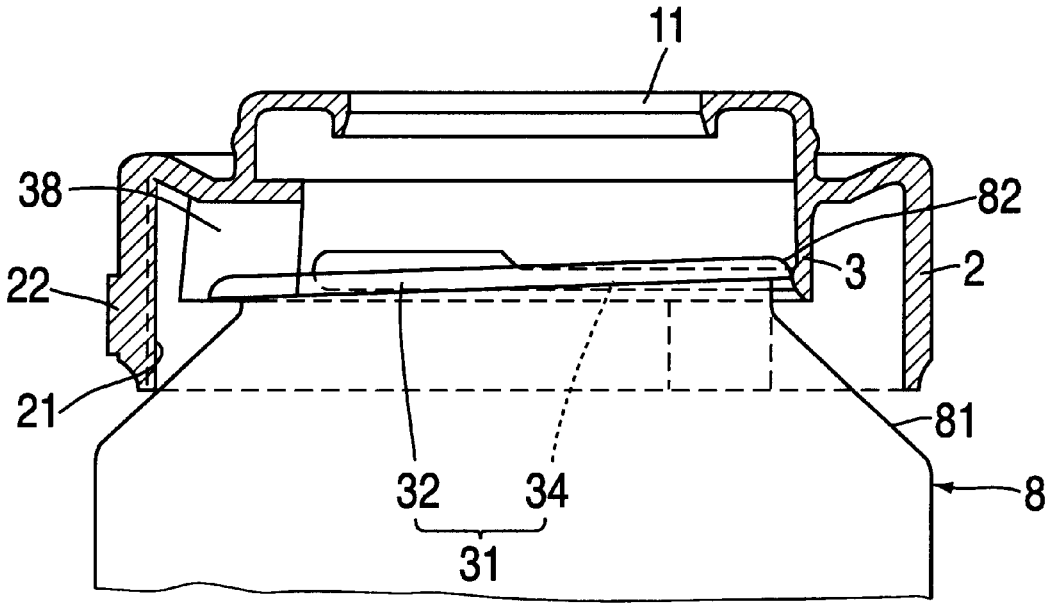

FIG. 3 shows the final stage of the pressing operation. Circumferential ends 32 of lip 31 slides over curl 82 of metal container 8; side portion 34 of lip 31 comes off curl 82; and back portion 37 of lip 31 which is opposite to opening 36 slips off curl 82.

Plastic cover 5 which has single cylinder wall 6, is combined with metal container 8 by engagement between lip 61 of single cylinder wall 6 and curl 82 of metal container 8.

When a user pushes the push button associated with the nozzle (not shown) which is employed in the inner side of the single cylinder 6, the contents of container 8 are jetted outside from metal container 8 through the nozzle in opening 69.

Figure 5C:
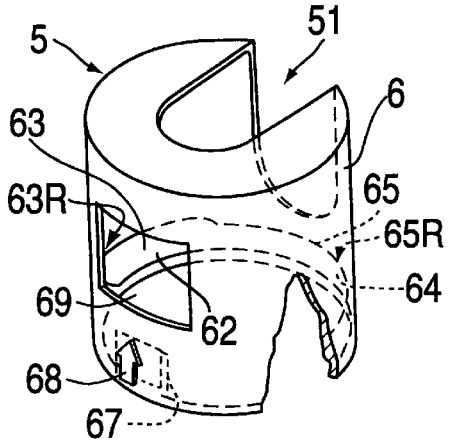
Figure 6A:
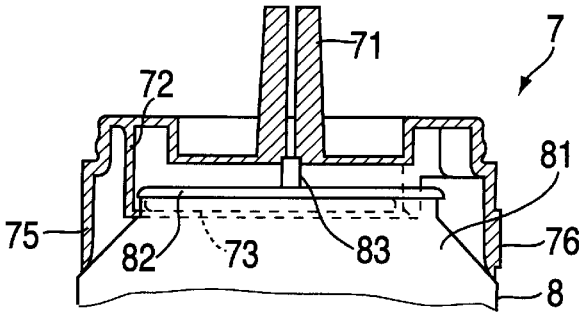
FIG. 6A PRIOR ART
FIGS. 6A, 6B and 6C illustrate a prior art releasable cover and how that cover is removed from the container.
Figure 6B:
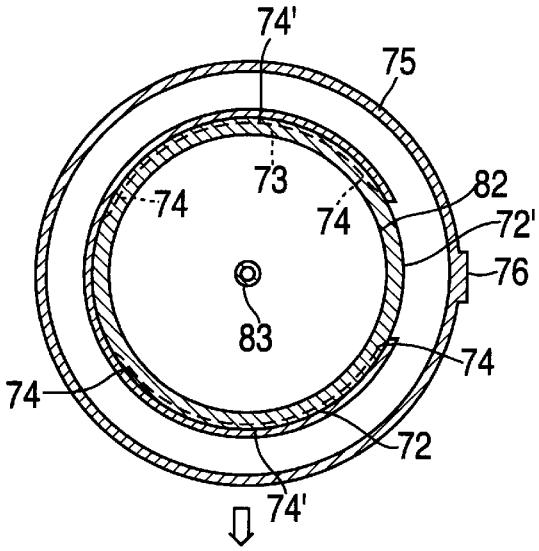
FIG. 6B PRIOR ART
Figure 6C:
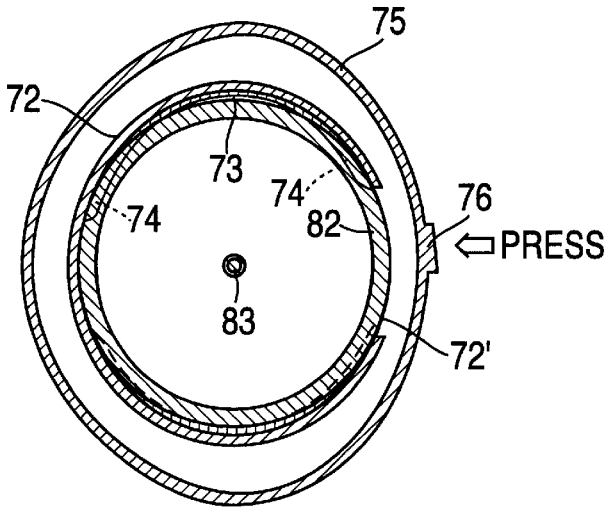
FIG. 6C PRIOR ART
Figure 7A:
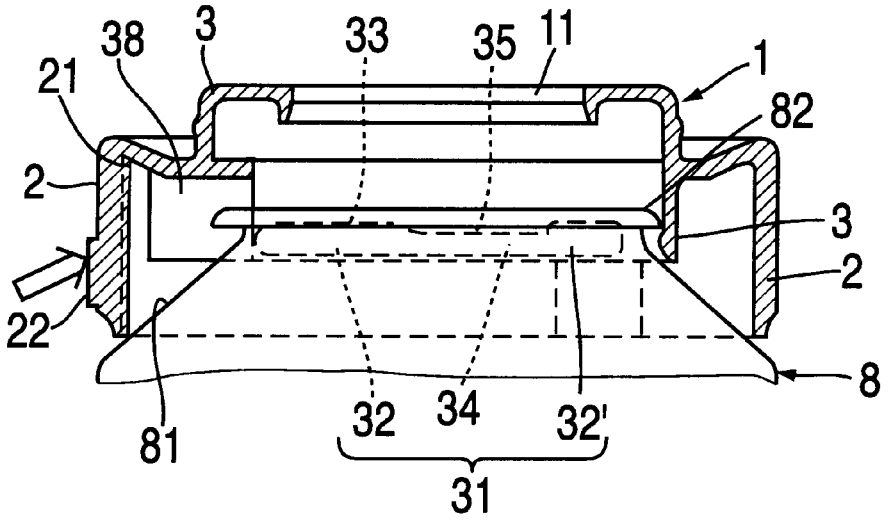
FIGS. 7A and 7B illustrate an alternate embodiment of the cover of FIGS. 1A and 1B.
Figure 7B:
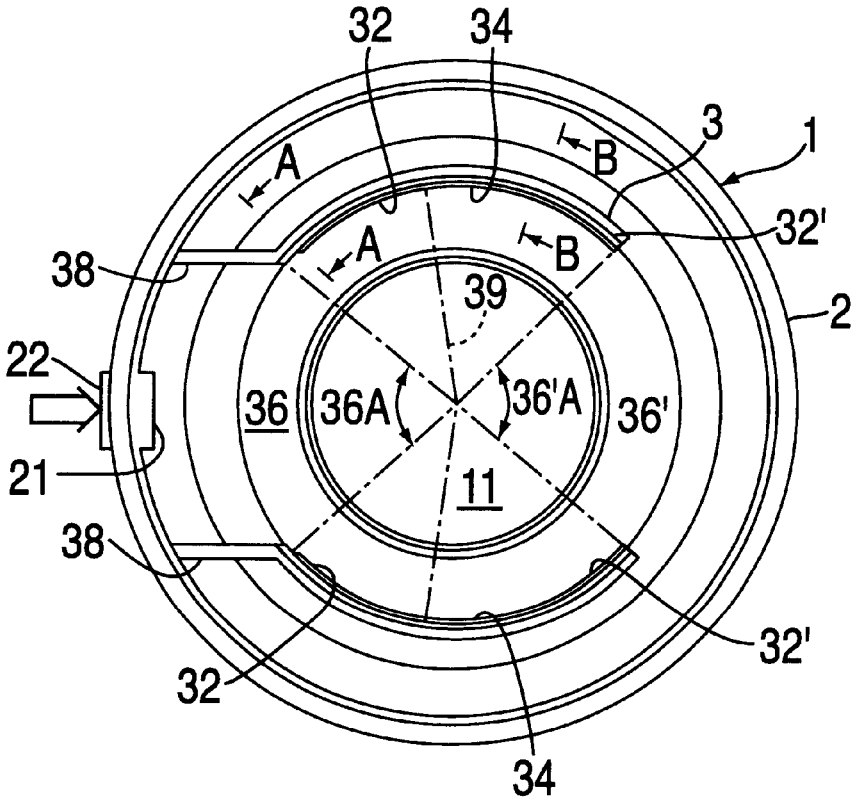
Figure 8A:
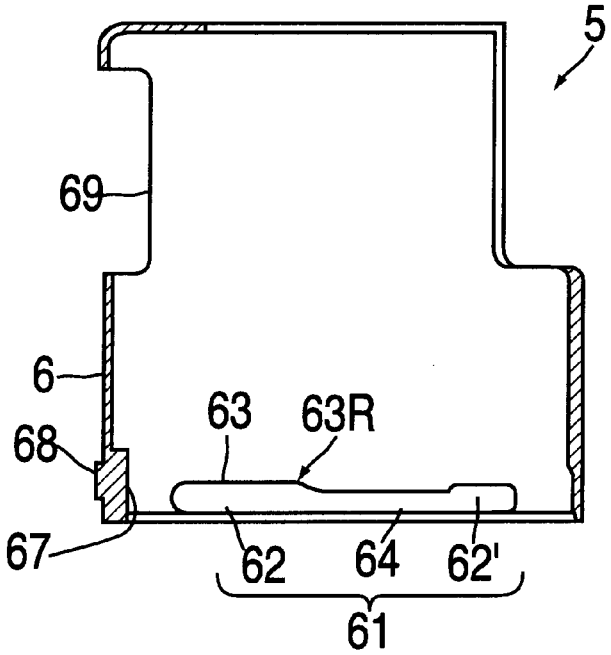
FIGS. 8A and 8B illustrate an alternate embodiment of the cover of FIGS. 5A and 5B.
Figure 8B:
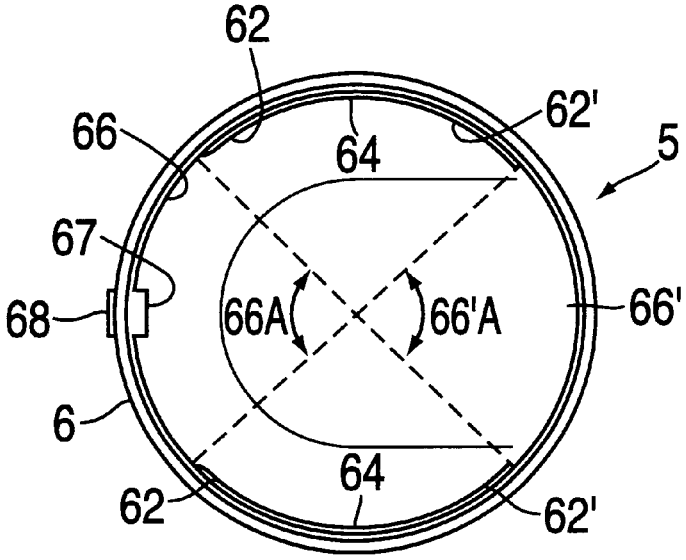

After the contents are used up, plastic cover 5 is removed from metal container 8 by pressing press point 68 of single cylinder portion 6 in the direction of an arrow shown in FIG. 5C.

When the transformation into an elliptical shape of plastic cover 5 is small, lip 61 receives the above-mentioned upward force, and is lifted from circumferential ends 62 which has a lower degree of engagement with metal container 8 than side portion 64.

According to the present invention, the plastic cover is easily removed from the metal container because the circumferential ends of the lip, which is formed in the cylindrical portion of the plastic cover (the inner cylinder of the double cylinder or the single cylinder), have a lower degree of engagement with the curl of the metal container than the side portion of the lip.

Also, since a shoulder is formed in the part which corresponds to the opening in the lip and contacts the sloping wall section of the metal container at almost the same time when the corresponding portion is pressed inward, a direction of pushing up, the plastic cover is moved upward guided by the sloping wall section of the metal container.

Additionally, since the circumferential ends of the lip and the outer cylinder are connected by a rib so as to transfer pressing force from the outer cylinder to the inner cylinder, the degree to which the lip is transformed to an elliptical shape is high. This means that the side portion which follows the circumferential ends is easily released from the metal container.

It will be appreciated that modifications may be made in the present invention. For example, the width of the lip in the direction of diameter can be varied such that the width of the lip at the circumferential ends is less than the width of the lip at the side portions. The friction coefficient and the degree of elasticity (stiffness) of the circumferential ends can be lower than the side portion of the lip.

The plastic cover may be moved upward by the pushing up operation of the user without the upward action from the sloping wall section of the metal container.

Also, instead of the lip formed in the plastic cover, the curl engaging member can be a concave portion which is formed in the plastic cover such that the curl of the container resides in the concave portion of the cover when the cover is on the container.

Additionally, the nozzle and the like need not be employed in the plastic cover.

Furthermore, the shoulder may be formed in any place which can receive upward force from sloping sidewall of the metal container when the press point is pressed.

Further, the lip may be formed dividedly, provided it employ the circumferential ends, e.g. the present invention may be used in the arrangement shown in FIGS. 7A–7B and 8A–8B, wherein there are four circumferential ends 32, 32', 62, 62', and two openings 36, 36', 66, 66'.

It will be understood that the claims are intended to cover all changes and modifications of the preferred embodiments of the invention herein chosen for the purpose of illustration which do not constitute a departure from the spirit and scope of the invention.

What is claimed is:

1. In a plastic cover attached to a metal container wherein the container has a curl and the plastic cover has a curl engaging member that holds the cover onto the container by engaging under the curl, the improvement comprising:

said curl engaging member having one or more radially inwardly extending protrusions, each of said one or more protrusions having two spaced circumferential ends and a side portion positioned between said two circumferential ends, each of said one or more protrusions also having a concave top portion which is adapted to receive said curl;

wherein said circumferential ends have a first degree of engagement and said side portion of said curl engaging member having a second degree of engagement; said first degree of engagement being less than said second degree of engagement;

wherein said first degree of engagement is a first radius of curvature of the concave top portion of said circumferential ends; said second degree of engagement is a second radius of curvature of the concave top portion of said side portion; and said first radius is greater than said second radius.

2. The cover of claim 1 wherein said curl engaging member is a lip.

3. The cover of claim 1 wherein said cover has a press point positioned outside said cover at a point opposite an opening between two circumferential ends and a shoulder positioned inside said cover.

4. The cover of claim 1 wherein said cover has an inner cylinder upon which said curl engaging member is formed and an outer cylinder.

5. The cover of claim 4 wherein two or more ribs connect said outer cylinder with said inner cylinder.

6. The cover of claim 4 wherein said inner cylinder corresponds to said curl engaging member and is open between said circumferential ends.

7. The cover of claim 6 wherein said ribs are connected to said inner cylinder at said circumferential ends.

* * * * *